US005388794A

United States Patent [19]

Wolff

[11] Patent Number: 5,388,794

[45] Date of Patent: Feb. 14, 1995

[54] BANNER BRACKET

[76] Inventor: Leslie C. Wolff, Box 188, Lakeview Dr., Hackensack, Minn. 56452

[21] Appl. No.: 5,038

[22] Filed: Jan. 15, 1993

[51] Int. Cl.[6] ..... A47B 96/06

[52] U.S. Cl. ..... 248/219.4; 40/604; 40/607; 248/231

[58] Field of Search ..... 248/218.4, 219.2, 219.1, 248/219.3, 219.4, 230, 231, 201, 220.2, 289.1; 40/603, 604, 607

[56] References Cited

U.S. PATENT DOCUMENTS

| | | | |
|---|---|---|---|
| 3,183,886 | 5/1965 | Moffitt, Jr. | 40/607 X |
| 3,850,401 | 11/1974 | Snediker | 40/604 X |
| 4,548,377 | 10/1985 | Huel | 40/607 X |
| 4,880,195 | 11/1989 | Lepley | 40/607 X |
| 5,040,586 | 8/1991 | Hillstrom | 40/603 X |
| 5,288,050 | 2/1994 | Armstrong | 248/289.1 X |

*Primary Examiner*—Ramon O. Ramirez

[57] ABSTRACT

Apparatus for suspending a flexible banner with respect to an upstanding post and including a pair of base plates that are fixed in spaced relation on the post, the base plates each having a pair of grooves extending longitudinally of the post adjacent the side edges of the base plate and a pair of swing plates having a pair of longitudinally extending lips that rest normally in the pairs of grooves in the base plates and each having means for fixing a banner supporting rod in the swing plate whereby the swing plates and the rods may be pivoted with respect to the base plate, and a spring between each of the swing plates and its respective base plate for yieldably restraining swinging movement of the swing plate and its rod.

9 Claims, 4 Drawing Sheets

Fig- 3
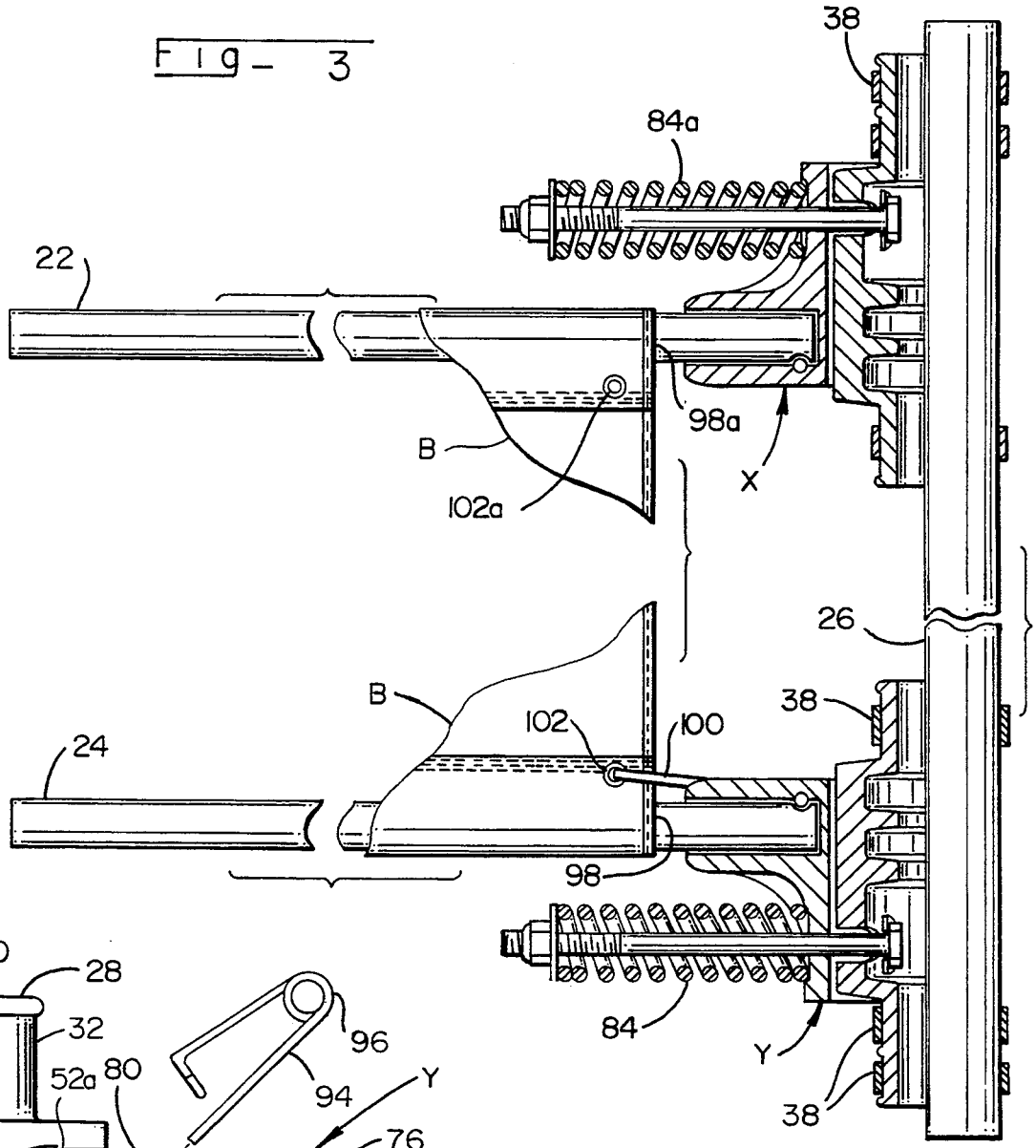
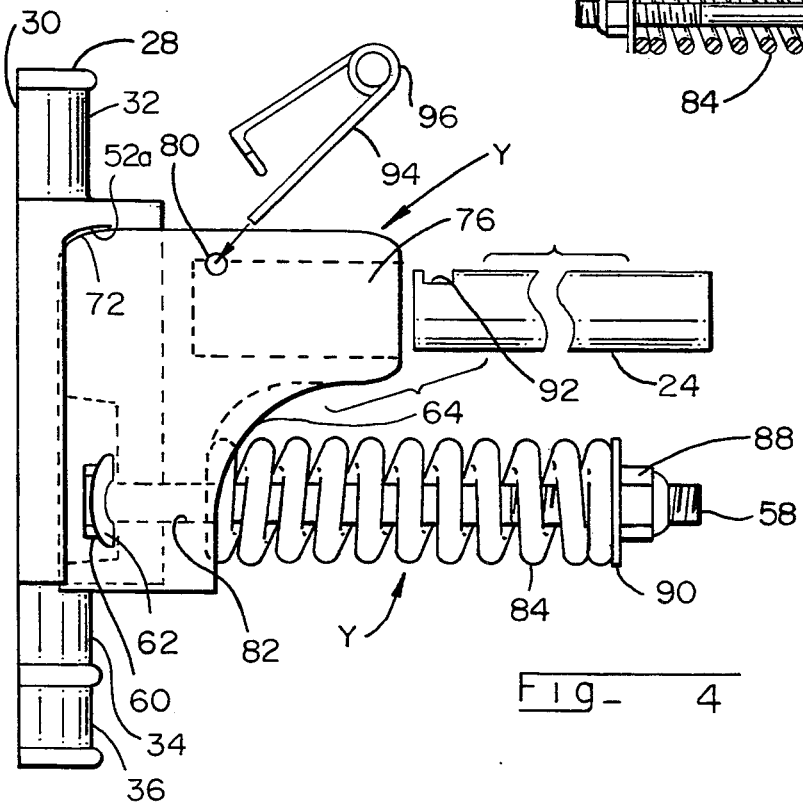
Fig- 4

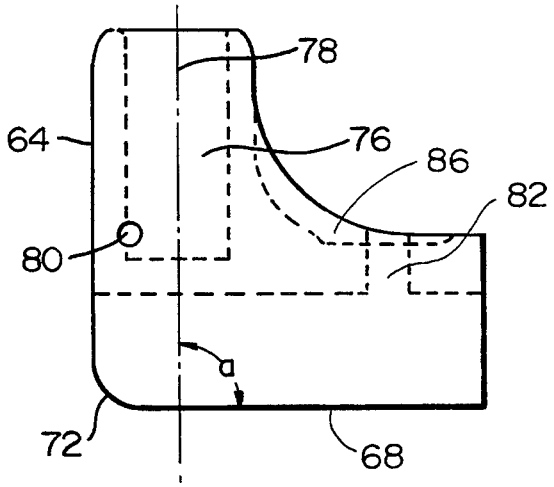
Fig- 7
Fig- 8
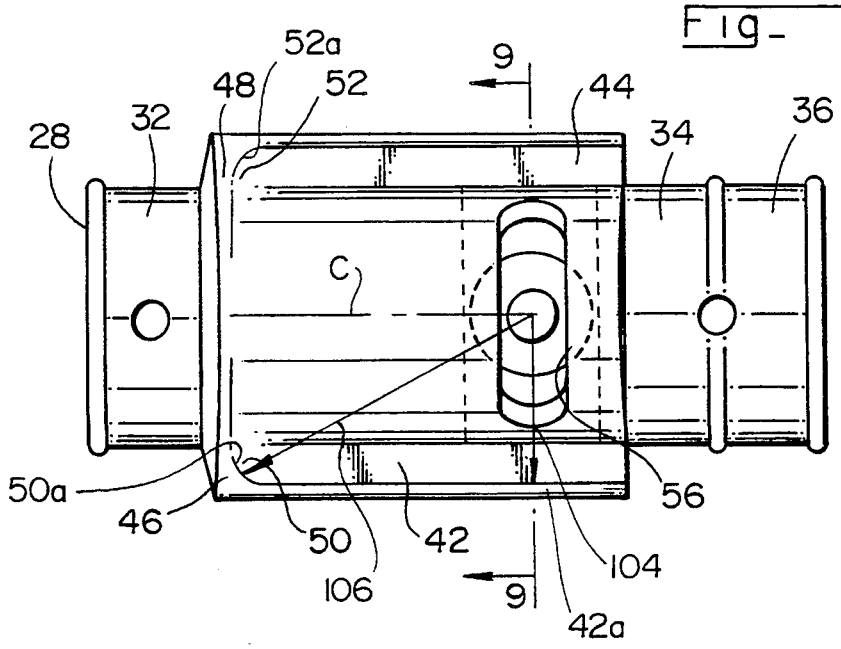
Fig- 9
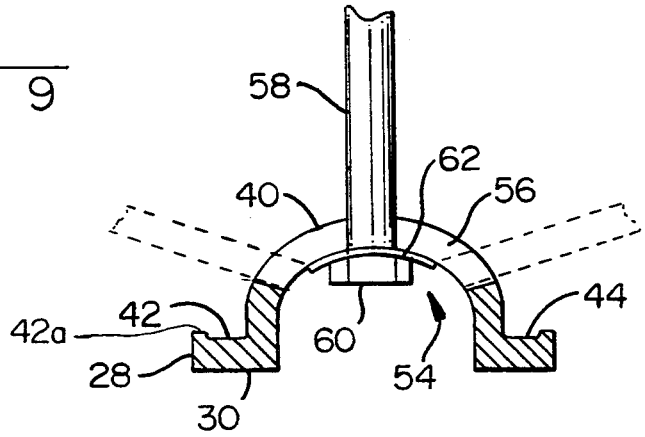

BANNER BRACKET

BACKGROUND OF THE INVENTION

The invention relates to vertically mounted decorative banners, typically mounted on city street poles and more particularly, the invention relates to brackets by means of which the banners may be so mounted.

The current mounting technique for such banners is to mount such a banner vertically with the top horizontal edge of the banner and also the bottom horizontal edge each being provided with a hem that runs the entire width of the banner and allows a banner arm to be inserted into the entire length of the hem. Such a banner arm is typically a fiberglass rod or a steel tube mounted at 90° to a short bracket base which may be 5 to 7 inches (12.7 to 17.7 cm.) in length. This mounting may be of a permanent nature, a steel banner arm being welded at 90° to the bracket base. The banner arm may also be of a removable nature with a fiberglass rod or steel tube inserted into a female socket or nipple, usually 2 inches in depth. In each case, the bracket base is fixed to the city street pole, such as by stainless steel strips that extend around the bracket base and around the pole although, in some cases, the bracket base is bolted onto the city street pole. If the banner arm is of the removable type, it is held in place by means of a pin extending diametrically through the banner arm and through matching holes drilled into and through the bracket base. Alternately, the banner arm may be attached to the bracket base by being threaded into the bracket base.

Removable banner arms are usually preferred, as banners are usually mounted for just a season (3 months), and when the banners are not in use, the detachable arms can be taken down easily with the banners, thereby leaving only the bracket bases attached permanently to the post. Brackets with permanently attached banner arms tend to be unsightly, with the two upper and lower banner arms sticking out approximately 30 inches (76.2 cm.) for example, at 90° to the pole. It is not feasible to mount and dismount the entire bracket each time the banner is to be removed, since the base must be very securely mounted to the pole.

The two mostly used vertical banner mounting systems are brackets with fiberglass rod banner arms and brackets with steel tube banner arms. The fiberglass arms are preferred since they flex up to approximately 4 inches (10.1 cm.) (with a banner of approximately 30 inches, 76.2 cm. for example), thereby offering a limited cushioning of wind gusts, but they do not flex enough to spill off high wind forces exerted against such a banner. High winds on a standard size large banner of approximately 30 inches (76.2 cm.), for example, can create forces in the 400 pound (181 kg.) per banner range, and without the capability of the banner being able to tip with the wind, this force is directly transferred to banner hem, banner arm, bracket base, and stainless steel strips, and finally to the pole.

With such a banner being mounted to a vertical city street pole, wind gusts result in tearing and destruction of such a banner, with the banner being torn and shredded so that it is eventually torn from the banner arms and lies in shreds on the ground beneath the arms. This is particularly true if the banner arms are fixed with respect to the bracket bases, although this same effect occurs when fiberglass banner arms are used which flex to some extent. The limited cushioning provided by the flexible fiberglass rod banner arms allows a greater wind effect being exerted on such a banner but is not sufficient to prevent destruction of such a banner with higher wind forces.

Prior to the present invention, the destructive effect of high winds on such banners has been reduced by mounting each fiberglass banner arm in a base plate which is held onto a bracket base by means of a spring. The base plate and bracket base are provided with planar surfaces held in contact by means of the spring, and the arrangement of the planar surfaces and spring allows a limited movement of the base plate receiving a banner rod with respect to the bracket base so that the combined effect of the flexing of the fiberglass rods and limited movement of the base plates with respect to the bracket bases protects the banner from destruction in winds that are not unduly great.

SUMMARY OF THE INVENTION

It is an object of the present invention to provide an improved banner mounting system and particularly an improved bracket which allows greater movement of a banner supporting rod under wind load than provided by the prior constructions so that such a banner remains intact under higher wind loads than is possible with prior constructions.

In a preferred form, the present invention comprises upper and lower swing bracket assemblies which respectively support the upper and lower edges of a banner with respect to a vertical supporting pole. Each of the bracket assemblies comprises a base casting which is attached to the supporting pole, a swing casting pivotedly mounted on the base casting and a fiberglass rod received in the swing casting and extending through a hem in an edge of the banner, with a pin extending through the swing casting and through a slot or notch provided in a surface of the fiberglass rod for holding the rod in the swing casting. The base casting is provided with opposite lineal vertically extending grooves that terminate in rounded closed ends, the upper ends in the case of the lower bracket and the lower ends in the upper bracket. The swing casting has lips that rest in the lineal grooves and has curved ends seated in these ends of the lineal grooves for providing substantial ball and socket joints. The swing casting, along with the banner and fiberglass banner rods, swings with respect to the base casting which is fixed with respect to the vertical pole; and the ball and socket joints allow vertical and swinging movement of the swing casting so that the banner arms and the banner may swing along with the wind pressure on the banner and the banner may belly out toward its outer edge, remote from the vertical supporting pole to spill the wind from the banner, keeping the banner intact in the case of high winds effective on the banner.

BRIEF DESCRIPTION OF THE DRAWINGS

FIG. 3 is a fragmentary vertical sectional view of the upper and lower swing bracket assemblies mounted on the supporting pole and holding the banner between the fiberglass rods of the two bracket assemblies;

FIG. 4 is a side elevational view on an enlarged scale of the lower bracket assembly comprising its base casting, its swing casting, its fiberglass rod, and its safety pin, the parts being exploded with respect to each other to better illustrate them;

FIG. 7 is a side view of the swing casting;

FIG. 8 is a top view of the base casting; and

FIG. 9 is a sectional view taken on line 9—9 of FIG. 8 and showing a swing casting retaining bolt extending through the base casting and the limiting positions of the retaining bolt.

DESCRIPTION OF THE PREFERRED EMBODIMENT

Figure 1:
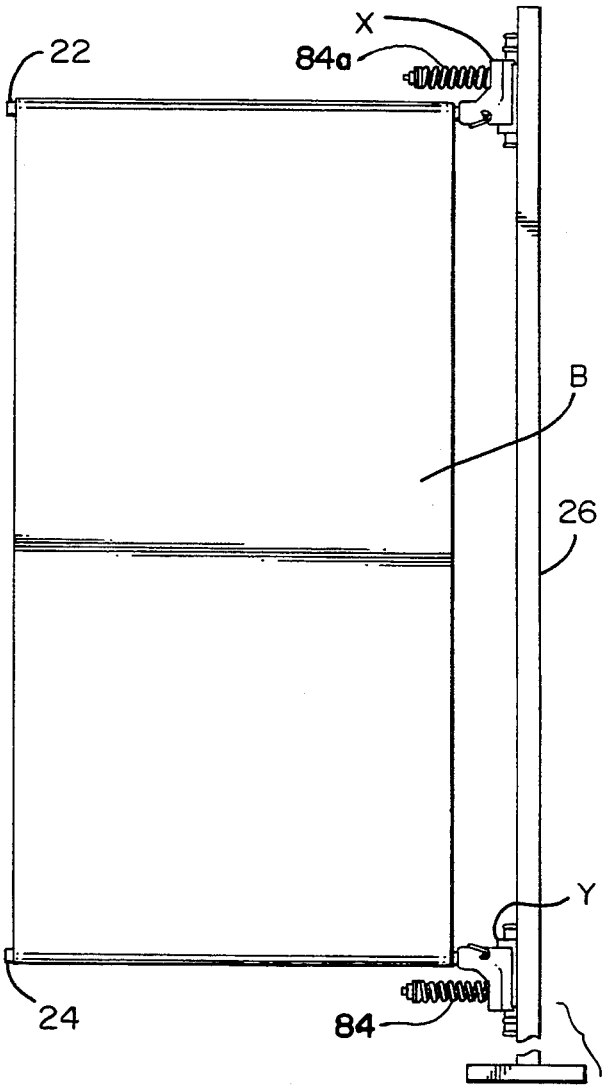
FIG. 1 is a frontal view of a banner and its supporting apparatus which comprises upper and lower swing bracket assemblies, with each bracket assembly comprising a base casting which is attached to a supporting pole, a swing casting pivotedly and tiltably mounted on the base casting, a fiberglass rod received in the swing casting, and a safety pin for holding the rod in the swing casting.

Referring to FIG. 1, the invention may be seen to comprise a banner B of flexible cloth or the like which is held taut between upper and lower fiberglass (plastic) rods 22 and 24 held in spaced relation by means of upper and lower bracket assembly X and Y. The bracket assemblies X and Y are fixed onto a vertical post 26 as will be more fully described hereinafter.

The bottom bracket assembly Y is shown in FIG. 4 and comprises a solid bottom base casting or plate 28 such as of aluminum and which is also shown in FIGS. 5, 6, 8, and 9 in more detail. The base casting 28 has a flat bottom surface 30, which is adapted to fit on the flat outer surface of the post 26. The casting 28 is formed with channels 32, 34, and 36 extending transversely of the longitudinal center line C of the casting 28 and adapted to receive stainless steel bands 38 that extend around the casting 28 and around the post 26 for fixing the casting 28 in surface to surface contact with the post 26, as is shown particularly in FIG. 3.

The casting 28 is formed with an upstanding cylindrical portion 40 extending longitudinally of the casting 28; and longitudinally extending, lineal side grooves 42 and 44 are provided on opposite sides of the cylindrical portion. Outwardly extending portions 46 and 48 terminate the grooves 42 and 44 respectively, so as to provide cavities 50 and 52 having concave rounded sides 50*a* and 52*a* respectively at the ends of the grooves 42 and 44, these cavities 50 and 52 being at the upper end of the casting 28 of assembly Y as it is mounted on the post 26. The portion 40 provides a cylindrical internal cavity 54 within the casting 28, and a transverse slot 56 extends through the portion 40 in communication with the cavity 54. A stud or bolt 58 for fastening purposes to be described extends through the slot 56 and has its head 60 within the cavity 54. A washer 62 is disposed about the bolt 58 within the cavity 54, and the washer 62 is bent into arcuate shape cylindrically (moon-shaped) so that it extends in close proximity and in contact with the inner cylindrical surface of the portion 40. As will be noted from FIG. 9, the head 60 is chamfered on its corners, and this forming of the head 60 together with the arcuate shape of the washer 62 allows the bolt 58 to move to the substantial limits of its movement in the slot 56 which are indicated FIG. 9.

Figure 5:
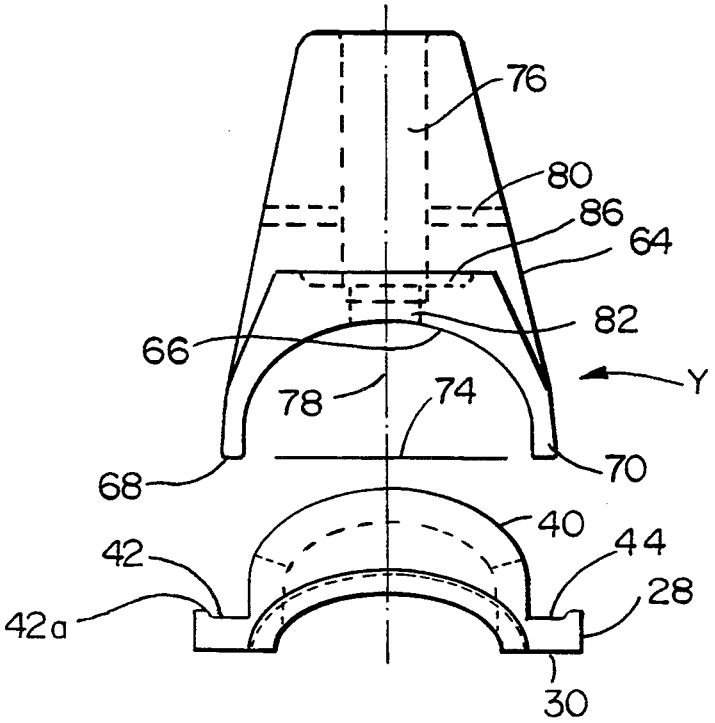
FIG. 5 is an end exploded view of a sub-assembly of the base casting and swing casting.

The bracket assembly Y also comprises the upper swing casting or plate 64 having an internal cylindrical surface 66 which fits over the cylindrical portion 40 of the lower casting 28 as is indicated in FIG. 5 and which holds the swing casting 64 from moving off of the base casting 28 sidewardly. The casting 64 has opposite depending side lips 68 and 70 which are disposed in the lineal grooves 42 and 44 of the bottom casting 28, and the lips 68 and 70 have curved ends 72 (see FIG. 7) that are approximately of the same shape as the ends 50*a* and 52*a* of the cavities 50 and 52 and rest in the latter cavities so as to form substantial ball and socket thrust joints with the upper ends 50*a* and 52*a* of the cavities 50 and 52 being the sockets and the curved ends 72 of the lips 68 and 70 being the balls. The ends of the lips 68 and 70 are in a plane 74 (see FIG. 5), and the swing casting 64 is formed with a cylindrical cavity 76 that receives the rod 24 and has its center line 78 at a small angle, such as $2\frac{1}{2}°$ less than 90°(the angle A in FIG. 7) with respect to the plane 74. The bottoms of the grooves 42 and 44 are parallel to the surface 30 resting on the outer surface of the post 26 so the rod 24 thus declines at the small angle a of about $2\frac{1}{2}°$ with respect to horizontal, assuming that the post 26 is vertical. A small hole 80 extends through the swing casting 64 and through the cavity 76 for purposes to be described.

The swing casting 64 has an opening or cavity 82 extending through it, and the bolt 58 extends through the opening 82 from the cavity 54 in the base casting 28. A spring 84 is disposed about the bolt 58 and is bottomed on a planar seat surface 86 provided on the casting 64, and a nut 88 and washer 90 restrain the other end of the spring 84.

The rod 24 is formed with a slot 92 (see FIG. 4) on its upper surface, and the slot 92 is in register with the opening 80 in the swing casting 64. Both the slot 92 and the opening 80 are off center as shown in FIG. 4, toward the top, for purposes to be hereinafter described. The tang portion 94 of a safety pin 96 extends through the opening 80 for the purpose of releasably fixing the rod 24 in the cavity 76. The rod 24 extends through a hem 98 in the lower edge of the banner B as shown in FIG. 3, and a flexible tie strip 100 extends through a grommet 102 in the hem 98 and around the adjacent safety pin 96 for releasably holding the banner B on the rod 24.

The bracket assembly X is identical with the bracket assembly Y, but is reversed as shown in FIG. 3, so that the spring 84*a* of the assembly X corresponding to and the same as the spring 84 of assembly Y is at the top rather than the bottom as is the spring 84 of assembly Y. The banner B has a hem 98*a* on its upper edge, and the fiberglass rod 22 carried by the bracket assembly X extends through the hem 98*a*. The hem 98*a* has a grommet 102*a* extending through it corresponding to the grommet 102 for receiving a tie strip 100.

In usage, the bracket assemblies Y and X are first installed on the post 26, which is assumed to be vertical as are most posts on city streets. The base casting 28 of the bracket assembly Y is held against the post 26 with the two adjacent transverse channels 34 and 36 of the casting being on the bottom, and stainless steel bands 38 are wrapped around the casting 28 and in the channels 32, 34 and 36, and around the post 26, with the stainless steel bands 38 thus fastening the base casting to the post 26. It is assumed that the bolt 58 and the washer 62 have first been installed in the base casting 28 so that the bolt 58 extends outwardly and at right angles to the post 26 and that the spring 84, washer 90 and nut 88 have been positioned and installed over the swing casting 64 of assembly Y. The flat bottom surface 30 of the base casting 28 is against the post 26; and it is assumed that the post 26 has a flat surface on which the surface 30 of the base casting 28 may fit, although the post 26 if desired can be curved or rounded, and in this case the bands 38 in the channels 32, 34 and 36 fix the base casting 28 onto the rounded post 26. Since the adjacent transverse channels 34 and 36 are on the bottom, the outwardly extending portions 46 and 48 of the base casting 28 and also the rounded cavities 50 and 52 at the ends of the grooves 42 and 44 are at the top of the assembly Y.

The base casting 28 of the bracket assembly X is installed on and fixed to the post 26 in the same manner; but, as has been described, the bracket assembly X is reversed with respect to the bracket assembly Y. Therefore, the adjacent transverse channels 34 and 36 for the bracket assembly X are at the top, and the outwardly extending portions 46 and 48 and the cavities 50 and 52 of the base casting 28 of the bracket assembly X are at the bottom and face and are opposite to the corresponding parts of the bracket assembly Y. It is assumed for the bracket assembly X that, as for the bracket assembly Y, the bolt 58 and the washer 62 have preliminarily been installed so that the bolt 58 of the assembly X extends outwardly away from the post 26. The upper swing casting 64, spring 84, washer 90 and nut 88 are also preliminarily installed in the assembly Y. The springs 84 and **84*a* of the assemblies X and Y are initially compressed slightly, and as is understood, the compression of the springs 84 and 84*a* may be varied by changing the positions of the nuts 88 and washers 90 on the bolts 58**.

The fiberglass rod 24 is then thrust into the cylindrical cavity 76 of assembly Y with its notch 92 being on its upper surface so that it matches and aligns with the hole 80 extending through the swing casting 64 which is at the top under these conditions. The tang portion 94 of the safety pin 96 is then moved through the hole 80 and through the notch 92 and is then clamped on itself to close the pin, thereby fixing the fiberglass rod 24 with respect to the swing casting 64 of assembly Y. The fiberglass rod 22 is then thrust into the cavity 76 of the swing casting 64 for the assembly X, and the fiberglass rod 22 is fixed with respect to the swing casting 64 of the assembly X by the safety pin 96 used for the assembly X. It will be noted that in the case of the assembly X, since the assembly X is reversed with respect to the assembly Y, the hole 80 and the notch in the rod 22 corresponding to the notch 92 for the assembly Y are at the bottom.

The bracket assemblies X and Y are now completed together with the fiberglass rods 22 and 24, and under these conditions, it will be noted that the outwardly extending portions 46 and 48 of the two base castings 28 are adjacent to and opposite each other, that is, the outwardly extending portions 46 and 48 of the upper bracket assembly X are on the lower end of this bracket assembly while the portions 46 and 48 of the lower bracket assembly Y are on the upper end of the bracket assembly Y. In both of the assemblies X and Y, the swing casting 64 has its lips 68 and 70 in the longitudinally extending grooves 42 and 44 of the base casting 28 which extend vertically, along with the post 26. In both cases, the curved ends 72 of the lips 68 and 70 rest on the ends **50*a* and 52*a* of the cavities 50 and 52 of the base casting 28. Since the cavity 76 in each of the swing castings 64 is at the angle a, as has been described, the fiberglass rods 22 and 24, although in the same vertical plane, diverge slightly with respect to each other and are not exactly perpendicular to the post 26** for purposes to be described.

The banner B is now installed on the fiberglass rods 22 and 24 by slipping the hems 98 and **98*a* over the rods 22 and 24 and at the same time stressing the rods 22 and 24 slightly so as to bring them into parallelism. As shown in FIG. 3, the banner B is brought into close proximity with the swing castings 64 of assemblies X and Y, and the tie strips 100 are then passed through the grommets 102 and 102*a* and tied around the adjacent safety pins 96 so as to hold the upper and lower edges of the banner B in proper position adjacent the swing castings 64** of the bracket assemblies X and Y.

It is assumed that the bracket assemblies X and Y are so spaced on the post 26 that the side edge of the banner B adjunct the post 26 is held taut by the rods 22 and 24, and the rest of the banner B outwardly from the post 26 is also held taut due to the inherent flexibility of the rods 22 and 24 and the fact that these rods 22 and 24 have been stressed to bring them into parallelism when the banner B is installed on the rods 22 and 24. The banner is now in a desired position extending outwardly at 90° to the post 26.

As has been described, winds will tend to cause such banners, as the banner B, to be torn from their opposite support rods and shredded and destroyed, unless means is provided for allowing the banner to be moved and bellied out to spill the wind from the banner. The natural resilience of the fiberglass rods 22 and 24 allows the rods to yield and bend and allows such a bellying out of the banner under light winds or breezes, with the outer edge of the banner being arc-shaped. The banner B produces a downward force on the rod 22 and an upward force on the rod 24 as well as horizontal forces in the direction of the wind and transmitted to the swing castings 64, but the springs 84 and **84*a* are of sufficient strength to hold the swing castings 64 in their initial positions seated on the base castings 28** for these light winds or breezes.

Figure 2:
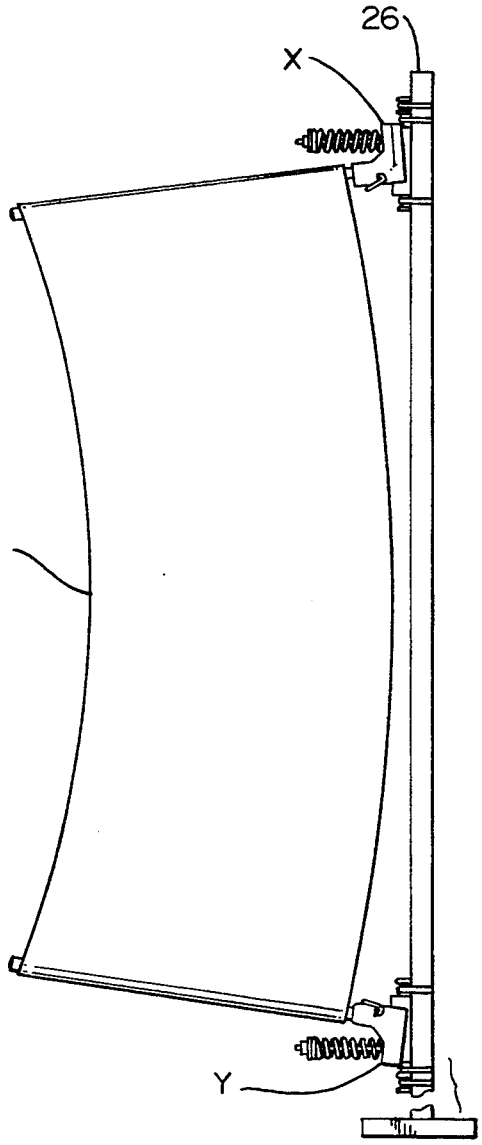
FIG. 2 is a perspective view of the banner as supported by the fiberglass rods of the upper and lower swing bracket assemblies and bellied out due to the application of wind to the banner.
Figure 6:
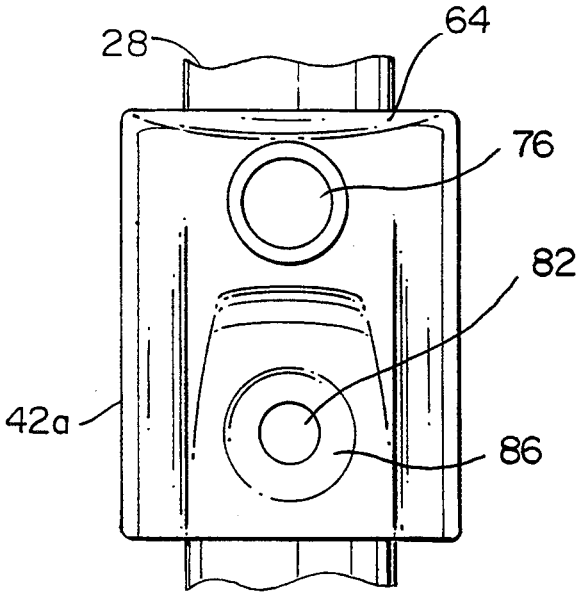
FIG. 6 is a top view of the sub-assembly of FIG. 5.

For greater wind velocities the natural resilience of the fiberglass rods 22 and 24 is not sufficient for preventing destruction of the banner, and the swing castings 64 swing or tilt against the action of the springs 84 and **84*a*, with the lower swing casting 64 pivoting in the lineal groove 42 for example (see FIG. 5) for one wind direction. Since the casting 28 for the upper bracket assembly X is reversed with respect to the lower casting 28, the side groove 42 in the lower casting 28 is in alignment with the side groove 44 in the upper casting 28, and the swing castings 64 and particularly the lips 68 and 70 pivot in the grooves 42 and 44 of the lower and upper bracket assemblies Y and X respectively. It is assumed that the main force on the rods 22 and 24 is horizontal along with the wind. This pivoting action of the swing castings 64 is with corresponding swinging movement of the bolts 58 within the arcuate slots 56 and with movement of the moon-shaped washers 62 on the inner surfaces of the upstanding cylindrical portions 40 of the base castings 28 as will be understood. It will be appreciated that under these conditions the active lip (lip 68, for example, see FIG. 5) bears against the outer edge or rim surface of its groove (the surface 42*a* of the groove 42, for example, see FIG. 5) so that the rim surface 42*a* and the cooperating rounded end of the lip 68 constitute a swing thrust joint. These swinging movements of the swing castings 64 in the linearly extending side grooves 42 and 44 and against the action of the springs 84 and 84***a* is sufficient to allow sufficient bellying of the banner B with its outer edge being in arcuate shape while its inner edge remains more straight, such as is shown in FIG. 2, to successfully spill sufficient wind from the banner B to prevent its destruction. Under these conditions, the opposite lips (lip 70 for assembly Y for example, see FIG. 5) has been moved out of contact with the bottom of its groove (groove 44 for assembly Y, see FIG. 5).

For still greater wind velocities, the lips 68 and 70 in the two assemblies X and Y lift off of the bottoms of the grooves 42 and 44, and the rounded ends 72 of the lips 68 and 70 bear against and pivot with respect to the ends 50*a* and 52*a* of the rounded cavities 50 and 52 with still greater stressing of the springs 84 and 84*a* to provide additional movement of the distal ends of the fiberglass rods 22 and 24 toward each other and in the direction of the wind and to provide additional bellying of the banner B with greater arcuate shape of the outer edge of the banner B and with additional spilling of the wind from the banner B to prevent its destruction. It will be appreciated that under these conditions, the rounded ends 72 of the lips 68 and 70 along with the cooperating ends 50*a* and 52*a* of the cavities 50 and 52 constitute in effect ball and socket thrust joints allowing a rotation, tilting and pivoting of the swing castings 64 with respect to the base castings 28 to accommodate the differing swinging of the distal ends of the fiberglass rods 22 and 24, particularly toward and away from each other with differing wind velocities and directions.

The springs 84 and 84*a* are effective to return the swing castings into their original positions with the lips 68 and 70 being in contact with the bottoms of the grooves 42 and 44 when the winds subside. It will be noted that the lips 68 and 70 are on opposite sides of the center line 78 so that the swing castings 64 and thus the rods 22 and 24 may swing in either direction for winds in opposite directions.

Vectors 104 and 106 superimposed on the base casting 28 in FIG. 8 illustrate the lever arms effectively in a swing casting 64 for the two directions of swing of the swing casting respectively for light winds and for higher velocity winds. Vector 104 is between the thrust side surface 42*a* of the groove 42, for example, and the center of the bolt 58 and spring 84 and is at right angles to the longitudinal center line C of the base casting 28 shown in FIG. 8 (and of the swing casting 64 when positioned on top of the base casting). Vector 106 extends between the thrust surface 50*a* of the cavity 50 and the center of the bolt 58 and spring 84 and extends obliquely with respect to the center line C and on the same side of the center line C as the vector 104. The vector 104 is relatively short, and the vector 106 is relatively long for accommodating the relatively small and high velocities of the wind when the two vectors are respectively effective.

The reason for locating the notch 92 on the upper surface of the rod 24 is so that the upward flexing of the rod 24 during usual usage does not tend to cause fracture at the place of anchorage of the rod 24 by the associated safety pin 96. The same reasoning applies to the location of the small hole 80 in the lower surface of the rod 22 in the bracket assembly X.

The assemblies X and Y are initially located so spaced on the post 26 that the banner B is taut; and, if the desired degree of tautness is not obtained initially, either one of the assemblies X or Y can be adjustably moved on the post 26 to obtain this result.

To disassemble the banner B with respect to the rods 22 and 24, the ties 100 are cut, and the banner B is simply pulled off of the rods 22 and 24 for storage, for example. The rods 22 and 24 may be removed from the assemblies X and Y simply by unlatching the safety pins 96 and withdrawing them from the assemblies X and Y whereby the rods may be then be pulled out of the cavities 76 also for storage, for example.

Advantageously, the upstanding cylindrical portion 40 on each of the base castings 28 prevents a swinging of the associated swing casting 64 in a plane at right angles to the center of the spring 84 and stud 58 and holds the swing casting 64 properly positioned on the base casting 28, and the spring 84 or 84*a* holds the swing casting 64 on the base casting 28. The lever arm 106 is advantageously longer than the lever arm 104, since the forces on the banner B are greater for the higher wind velocities at which the lever arm 106 is effective. The wind forces on the banner B are different also in direction for the higher velocities of the wind. The rods 22 and 24 have substantially horizontal forces (with little vertical force) on them for low wind velocities which is the direction of the wind at the time, but for higher wind velocities in the horizontal direction the rods 22 and 24 are drawn together to a much greater extent due to the bowing of the banner B, these forces being mostly vertical. Thus the lever arm 106 extends obliquely from the center line C toward the banner when bowed to accommodate the changed direction of the forces on the rods 22 and 24 while the lever arm 104 is at right angles to the center line C.

The banner mounting system described keeps the banner B taut both for no-wind and also for windy conditions. The system allows the banner B to tip and spill the wind at 25 (40 km.) to 30 (48 km.) miles per hour and at least as high as 80 miles (128 km.) per hour. The system allows a quick banner change and saves labor in this respect. It reduces stress on the banner B, bracket assemblies X and Y, the banding 38 and the pole 26.

I claim:

1. Apparatus for suspending a flexible banner which has hems on opposite edges and including a pair of rods that extend through the hems of the banner, an upstanding post, a pair of base plates that are fixed in spaced relation on said post, a pair of swing plates positioned respectively on said base plates, each of said base plates having a pair of grooves extending longitudinally of said post adjacent the side edges of the base plate, each of said swing plates having a pair of longitudinally extending lips that rest normally in the pair of said grooves in the base plate that supports the swing plate to allow tilting of the swing plate with respect to the base plate, each of said rods being fixed with respect to one of said swing plates, and a spring that is effectively between each of said swing plates and its respective base plate for yieldably restraining tilting of the swing plate and the said rod that is fixed with respect to the swing plate.

2. Apparatus as set forth in claim 1 in which said grooves are closed by means of outwardly extending portions in the respective base plate that provide rounded cavities at the ends of said grooves that are adjacent and opposite to the other one of said base plates and its associated swing plate, said lips having rounded ends that contact the rounded ends of said grooves so that each of the swing plates may tilt about the rounded ends of said lips.

3. A bracket assembly for holding a banner supporting rod and allowing tilting of the rod including a base plate, a swing plate positioned on said base plate, said base plate having a pair of grooves extending longitudinally of the base plate adjacent its side edges and said swing plate having a pair of longitudinally extending lips that rest normally in the pair of said grooves in the base plate to allow tilting of the swing plate with respect to the base plate, means provided in the swing plate for receiving the banner supporting rod, and a spring that is effectively between said swing plate and said base plate for yieldably restraining tilting of the swing plate and the rod with respect to the base plate.

4. A bracket assembly as set forth in claim 3, said grooves being closed by upstanding portions of the base plate and providing rounded cavities at the ends of the grooves, and said lips being provided with rounded ends that rest normally in said rounded cavities and bear on the rounded ends of the cavities to allow tilting of the swing plate with respect to the base plate about the rounded cavities against the action of said spring.

5. A bracket assembly for holding a banner supporting rod and allowing swinging of said rod and including a base plate, a swing plate positioned on said base plate with longitudinal centers of the plates in alignment, said swing plate having means for holding said rod, a stud extending through said plates and located on said longitudinal centers, a compression spring disposed about said stud and yieldably holding said swing plate on said base plate, and a ball and socket thrust connection between said plates and located obliquely from said stud and with respect to said longitudinal centers on one side of said longitudinal centers which allows said swing plate to abut said base plate on the ball and socket connection when tilted obliquely and to allow said swing plate to tilt obliquely outwardly against the action of said spring away from said base plate and allow corresponding movement of the banner supporting rod.

6. A bracket assembly as set forth in claim 5 and including means providing a second thrust connection between said plates provided by a part on said swing plate abutting against a part of said base plate and located on the same side of said longitudinal centers as said first named thrust connection and also aligned with a transverse center line on said stud whereby said swing plate may abut said base plate and tilt about said second thrust connection against the action of said spring along with said rod.

7. A bracket assembly as set forth in claim 6, said first named thrust connection being located farther from the center of said stud than said second thrust connection.

8. Apparatus for suspending a flexible banner which has hems on opposite edges and including a pair of rods that extend through the hems of the banner, an upstanding post having a longitudinal center, a pair of bracket assemblies located in spaced relation on said post, each of said bracket assemblies including a base plate having a longitudinal center and fixed on said post and also including a swing plate carrying one of said rods, said base plate also carrying a stud and a compression spring, said longitudinal centers of said plate and said post being in alignment and said stud extending through said plates and outwardly from said longitudinal centers at right angles to said post, said compression spring in each of said bracket assemblies being disposed about the respective stud and holding the respective swing plate on the respective base plate, each of said bracket assemblies including a ball and socket connection between said base and swing plates of the assembly and located obliquely from said stud of the bracket assembly and with respect to said longitudinal centers which allows the swing plate to abut the base plate on the ball and socket connection when the swing plate is tilted obliquely and to allow the swing plate and the corresponding one of said rods to tilt obliquely outwardly against the action of the corresponding spring, said bracket assemblies being disposed on said post with their ball and socket connections opposite to and facing each other so that said two rods swing together.

9. Apparatus for suspending a flexible banner which has hems on opposite edges and including a pair of flexible plastic rods that extend through the hems of the banner, an upstanding post, a pair of bracket assemblies fixed in spaced relation on said post and each including a part providing a cavity extending through it with one of said rods positioned in the cavity, the upper one of said rods being provided with a slot on its lower surface within the cavity in which the rod is positioned and the lower one of rods being provided with a slot in its upper surface within the cavity in which the rod is positioned, and a pin extending through each of said parts and through the slot in the rod positioned therein for fixing the rod within its cavity.

* * * * *